US012780756B2

(12) United States Patent
Rhodes et al.

(10) Patent No.: US 12,780,756 B2
(45) Date of Patent: Nov. 3, 2026

(54) S-TYPE GLASS FIBERS IN GAS GENERANT COMPOSITIONS FOR IMPROVED COMBUSTION IN PYROTECHNIC INFLATORS

(71) Applicant: Autoliv ASP, Inc., Ogden, UT (US)

(72) Inventors: Zayn Rhodes, Ogden, UT (US); Ivan V. Mendenhall, Promontory, UT (US); Francois Peremarty, Ogden, UT (US); Steven Butler, Logan, UT (US)

(73) Assignee: Autoliv ASP, Inc., Ogden, UT (US)

( * ) Notice: Subject to any disclaimer, the term of this patent is extended or adjusted under 35 U.S.C. 154(b) by 59 days.

(21) Appl. No.: 19/054,437

(22) Filed: Feb. 14, 2025

(65) Prior Publication Data

US 2026/0242307 A1 Aug. 20, 2026

(51) Int. Cl.
*C06B 23/00* (2006.01)
*C06B 41/00* (2006.01)

(52) U.S. Cl.
CPC ..... *C06B 23/001* (2013.01); *C06B 41/00* (2013.01)

(58) Field of Classification Search
None
See application file for complete search history.

(56) References Cited

U.S. PATENT DOCUMENTS 5,756,929 A 5/1998 Lundstrom et al.
7,503,987 B2 3/2009 Kawakami et al.
8,608,196 B2 12/2013 Quioc et al.
8,808,476 B2 8/2014 Mendenhall et al.
9,458,065 B2 10/2016 Kobayashi et al.
10,358,393 B2 7/2019 Rambow et al.
(Continued)

FOREIGN PATENT DOCUMENTS

CN 1714059 A 12/2005
CN 106247865 A 12/2016
(Continued)

OTHER PUBLICATIONS

DE 4209878 (Year: 1992).*
(Continued)

*Primary Examiner* — Aileen B Felton
(74) *Attorney, Agent, or Firm* — Harness, Dickey & Pierce, P.L.C.

(57) ABSTRACT

Methods for improving combustion stability in a gas generant for an inflatable restraint system are provided. S-type glass fibers are introduced into a mixture comprising at least one fuel and at least one oxidizer to form the gas generant. Each S-type glass fiber comprises silicon dioxide at ≥about 60% by mass, aluminum oxide at ≥about 20% by mass, and magnesium oxide at ≥about 9% by mass, and has a thermal softening point temperature ($T_d$) of greater than or equal to about 1,000° C. When the S-type glass fibers are absent, wherein the mixture exhibits flame extinguishment and/or reignition during combustion. However, combusting the gas generant comprising plurality of the S-type glass fibers is substantially free of flame extinguishment and/or reignition behavior and any associated pressure excursions. Gas generant compositions including the S-type glass fibers are also provided.

20 Claims, 3 Drawing Sheets

(56) References Cited

U.S. PATENT DOCUMENTS

Figure 1:
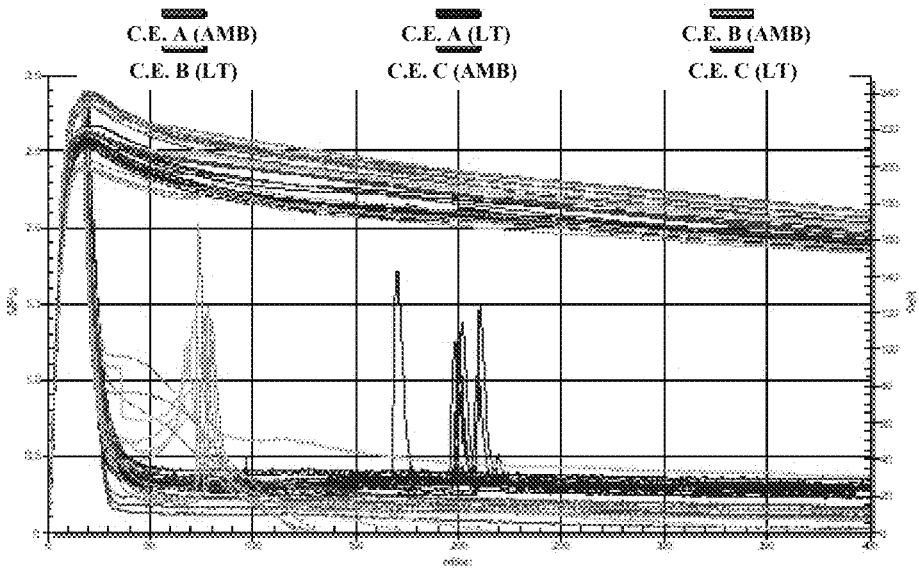

| | | | | |
|---|---|---|---|---|
| 2010/0116384 | A1* | 5/2010 | Mendenhall | C06B 21/0091 264/3.4 |
| 2013/0340900 | A1 | 12/2013 | Kobayashi et al. | |
| 2017/0334802 | A1 | 11/2017 | Rambow et al. | |
| 2024/0051895 | A1 | 2/2024 | Mendenhall et al. | |
| 2026/0131754 | A1 | 5/2026 | Luo et al. | |

FOREIGN PATENT DOCUMENTS

| | | | |
|---|---|---|---|
| CN | 116514615 | A | 8/2023 |
| EP | 1068165 | B1 | 3/2009 |
| EP | 3463991 | B1 | 1/2022 |
| WO | 2010056512 | A1 | 5/2010 |
| WO | 2024053710 | A1 | 3/2024 |
| WO | 2024129966 | A1 | 6/2024 |
| WO | 2024206755 | A2 | 10/2024 |

OTHER PUBLICATIONS

WO 0044690 (Year: 2000).*
International Search Report and Written Opinion of the ISA issued in PCT/US2026/015291, mailed Jun. 11, 2026; ISA/KR.

* cited by examiner

S-TYPE GLASS FIBERS IN GAS GENERANT COMPOSITIONS FOR IMPROVED COMBUSTION IN PYROTECHNIC INFLATORS

FIELD

The present disclosure relates to methods for improving combustion stability in pyrotechnic inflators, where the gas generant compositions comprise a plurality of S-type glass fibers.

BACKGROUND

This section provides background information related to the present disclosure which is not necessarily prior art.

Passive inflatable restraint systems (e.g., for vehicles) include an inflatable airbag cushion to prevent contact between the occupant and the vehicle to minimize occupant injuries. Airbag systems typically include an inflator that can be connected to the one or more inflatable airbags positioned within the vehicle, and can rapidly produce a quantity of inflation fluid or gas that can fill the airbag(s) to protect the occupant(s) from forcibly striking parts of the vehicle interior during collisions or roll-overs.

For example, side impact inflatable restraint installations provide improved occupant protection against vehicular impacts inflicted or imposed from directions other than head-on, in other words, "side impact." Pyrotechnic inflators used for side impact restraint systems have been developed with the aim of meeting certain ballistic performance characteristics (e.g., rapid burn rate and low burn rate slope) at a low maximum flame temperature of combustion. More specifically, relatively low flame temperatures and lower burn rate slopes allow for select airbag cushion materials (e.g., polyethylene terephthalate) and/or diminished airbag cushion reinforcements, along with reduced wall thickness of the pressure vessel (combustion chamber), helping to reduce system cost and weight.

However, it has been difficult to find gas generants with relatively low maximum flame temperature of combustion and low burn rate slopes, while maintaining a sufficiently high burn rate to inflate the airbag cushion in the required time. Moreover, while such formulations may meet certain ballistic performance requirements, they have been observed to be unstable under certain conditions, for example, being plagued with combustion instability, especially at cold temperatures, and thus undergoing unpredictable combustion. It would be desirable to provide an inflator device, for example, for a side impact inflatable restraint system, which is relatively cool-burning, but provides necessary inflation performance with improved combustion stability.

SUMMARY

This section provides a general summary of the disclosure, and is not a comprehensive disclosure of its full scope or all of its features.

In certain aspects, the present disclosure relates to a method for improving combustion stability in a gas generant for an inflatable restraint system. The combustion instability may be flame extinguishment and/or reignition behavior that is improved by such methods. The method includes introducing a plurality of S-type glass fibers into a mixture comprising at least one fuel and at least one oxidizer to form the gas generant. Each S-type glass fiber comprises silicon dioxide at greater than or equal to about 60% by mass, aluminum oxide at greater than or equal to about 20% by mass, and magnesium oxide at greater than or equal to about 9% by mass, and has a thermal softening point temperature ($T_d$) of greater than or equal to about 1,000° C. The mixture exhibits flame extinguishment and/or reignition during combustion when the plurality of S-type glass fibers is absent. However, when the gas generant comprising plurality of the S-type glass fibers combusts, it is substantially free of flame extinguishment and/or reignition behavior and any associated pressure excursions.

In one aspect, an amount of S-type glass fibers in the gas generant after the introducing is less than or equal to about 10% by weight of the gas generant.

In one aspect, the amount of S-type glass fibers is greater than or equal to about 1% by weight to less than or equal to about 5% by weight of the gas generant.

In one further aspect, the thermal softening point temperature ($T_d$) of the plurality of S-type glass fibers is greater than or equal to about 1,300° C.

In one aspect, the method may further comprise combusting the gas generant, where the combusting is substantially completed in less than or equal to about 50 milliseconds.

In one further aspect, the combusting of the gas generant occurs at a temperature of −40° C.

In one aspect, the at least one fuel comprises a primary fuel and a secondary fuel comprising melamine nitrate at greater than or equal to about 1% by weight to less than or equal to about 20% by weight of the gas generant and the at least one oxidizer comprises a primary oxidizer and at least one secondary oxidizer comprising potassium perchlorate at greater than or equal to about 5% by weight to less than or equal to about 20% by weight of the gas generant, wherein during the combusting, the gas generant exhibits (i) a linear burn rate of greater than or equal to about 20 mm/second at 20 MPa, (ii) a burn rate slope is less than or equal to about 0.45, (iii) a maximum flame temperature at combustion ($T_c$) is less than or equal to about 2100K.

In one aspect, the primary fuel comprises guanidine nitrate at greater than or equal to about 20% by weight to less than or equal to about 60% by weight of the gas generant and the primary oxidizer comprises basic copper nitrate at greater than or equal to about 20% by weight to less than or equal to about 60% by weight of the gas generant.

In one aspect, the plurality of S-type glass fibers are milled and each S-type glass fiber of the plurality of S-type glass fibers has an average aspect ratio (AR) ranging from about 10:1 to about 20:1 and has a length of greater than or equal to about 60 micrometers to less than or equal to about 260 micrometers.

In one aspect, each S-type glass fiber of the plurality of S-type glass fibers has silicon dioxide at greater than or equal to about 61% by mass, aluminum oxide at greater than or equal to about 23% by mass, magnesium oxide at greater than or equal to about 9% by mass, boron oxide at greater than or equal to about 4% by mass, calcium oxide at about 0.05% by mass, cumulative other oxides at about 0.06% by mass, and a balance impurities, which has a modulus of elasticity of greater than or equal to about 85 MPa, a tensile strength of greater than or equal to about 4,500 MPa, a percent elongation of greater than or equal to about 5%, and a density of greater than or equal to about 2,400 kg/m$^3$.

In certain other aspects, the present disclosure relates to a gas generant composition that comprises a primary fuel, melamine nitrate at greater than or equal to about 1% by weight to less than or equal to about 20% by weight of the gas generant composition, a primary oxidizer, potassium perchlorate at greater than or equal to about 5% by weight to less than or equal to about 20% by weight of the gas generant composition, and a plurality of S-type glass fibers. Each glass fiber comprises silicon dioxide at greater than or equal to about 60% by mass, aluminum oxide at greater than or equal to about 20% by mass, and magnesium oxide at greater than or equal to about 9% by mass and has a thermal softening point temperature ($T_d$) of greater than or equal to about 1,000° C. During combustion of the gas generant composition: (i) a linear burn rate is greater than or equal to about 20 mm/second at 20 MPa, (ii) a burn rate slope is less than or equal to about 0.45, and (iii) combustion is substantially free of extinguishment or reignition behavior and any associated pressure excursions.

In one aspect, the plurality of glass fibers is present at greater than or equal to about 1% and less than about 10% by weight of the gas generant composition. In one aspect, the primary fuel comprises guanidine nitrate and is present at greater than or equal to about 20 to less than or equal to about 60 weight % of the total gas generant composition. The primary oxidizer comprises basic copper nitrate that is present at greater than or equal to about 20 to less than or equal to about 60 weight % of the total gas generant composition.

In one aspect, the amount of S-type glass fibers is greater than or equal to about 1% by weight to less than or equal to about 5% by weight of the gas generant.

In one aspect, the thermal softening point temperature ($T_d$) of the plurality of S-type glass fibers is greater than or equal to about 1,300° C.

In one aspect, during combustion, the gas generant exhibits (ii) a burn rate slope is less than or equal to about 0.42 and (iii) a maximum flame temperature at combustion ($T_c$) of less than or equal to about 2100K.

In one aspect, the plurality of S-type glass fibers are milled and each S-type glass fiber of the plurality of S-type glass fibers has an average aspect ratio (AR) ranging from about 10:1 to about 20:1 and has a length of greater than or equal to about 6 micrometers to less than or equal to about 260 micrometers.

In one aspect, each S-type glass fiber of the plurality of S-type glass fibers has silicon dioxide at greater than or equal to about 61% by mass, aluminum oxide at greater than or equal to about 23% by mass, magnesium oxide at greater than or equal to about 9% by mass, boron oxide at greater than or equal to about 4% by mass, calcium oxide at about 0.05% by mass, cumulative other oxides at about 0.06% by mass, and a balance impurities. Each S-type glass fiber further may have a modulus of elasticity of greater than or equal to about 85 MPa, a tensile strength of greater than or equal to about 4,500 MPa, a percent elongation of greater than or equal to about 5%, and a density of greater than or equal to about 2,400 kg/m$^3$.

In one aspect, the burn rate slope is less than or equal to about 0.42.

In certain further aspects, the present disclosure relates to a gas generant composition that comprises a primary fuel comprising guanidine nitrate at greater than or equal to about 20 to less than or equal to about 60 weight % of the total gas generant composition. The gas generant composition may further comprise melamine nitrate at greater than or equal to about 1% by weight to less than or equal to about 20% by weight of the gas generant composition. A primary oxidizer comprises basic copper nitrate at greater than or equal to about 20 to less than or equal to about 60 weight % of the total gas generant composition. Potassium perchlorate is also present at greater than or equal to about 5% by weight to less than or equal to about 20% by weight of the gas generant composition. The gas generant composition also has a plurality of S-type glass fibers at greater than 0 to less than or equal to about 10 weight % of the total gas generant composition. Each S-type glass fiber comprises silicon dioxide at greater than or equal to about 60% by mass, aluminum oxide at greater than or equal to about 20% by mass, and magnesium oxide at greater than or equal to about 9% by mass and has a thermal softening point temperature ($T_d$) of greater than or equal to about 1,000° C. The gas generant composition also optionally has one or more additives cumulatively present at greater than or equal to 0% to less than or equal to about 10% by weight of the gas generant composition. During combustion of the gas generant composition: (i) a linear burn rate is greater than or equal to about 20 mm/second at 20 MPa, (ii) a burn rate slope is less than or equal to about 0.45, (iii) a maximum flame temperature at combustion ($T_c$) of less than or equal to about 2100K, and (iv) combustion is substantially free of extinguishment or reignition behavior and any associated pressure excursions.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 shows a comparison of combustion performance for three conventional gas generants having slagging agents/combustion aids but exhibiting combustion instability due to flame extinguishment and reignition tested at ambient conditions (AMB/RT, about 24° C.) and at −40° C. (low-temperature or LT) in an inflator having a Type A Filter. A first comparative example (Comparative Example A) contains E-glass fibers as a combustion/slagging aid. A second comparative example (Comparative Example B) also has E-glass fibers. A third comparative example (Comparative Example C) shows combustion of a gas generant where crystalline silicon dioxide is used as a slagging/combustion aid.

Figure 2:
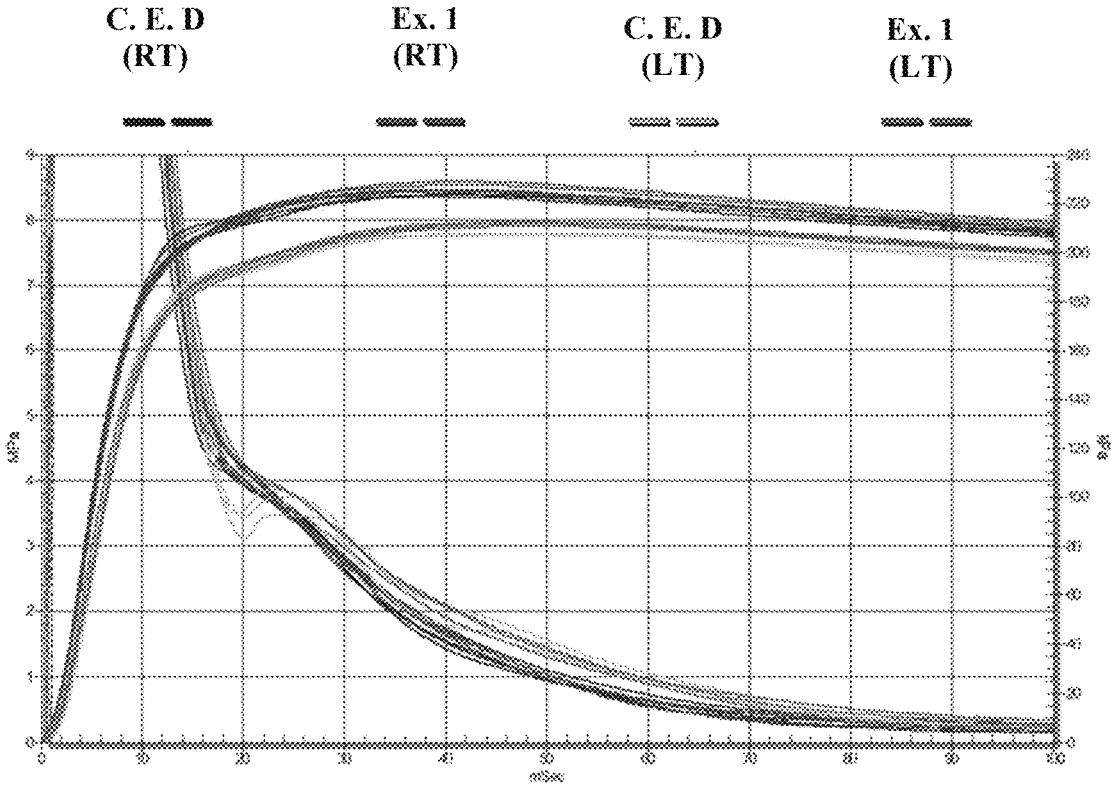

FIG. 2 shows a comparison of combustion performance at ambient conditions (RT) and at −40° C. (LT) for a conventional gas generant versus an example prepared in accordance with certain aspects of the present disclosure. More specifically, a fourth comparative example (Comparative Example D) of a gas generant suffering from flame extinguishment and re-ignition having E-type glass fibers is compared to Example 1 of the same gas generant having S-type glass fibers in accordance with various aspects of the present disclosure. A distinct peak is seen at low-temperature (LT) deployment for Comparative Example D when compared to ambient conditions, whereas Example 1 deployment shows no peak separation behavior.

Figure 3:
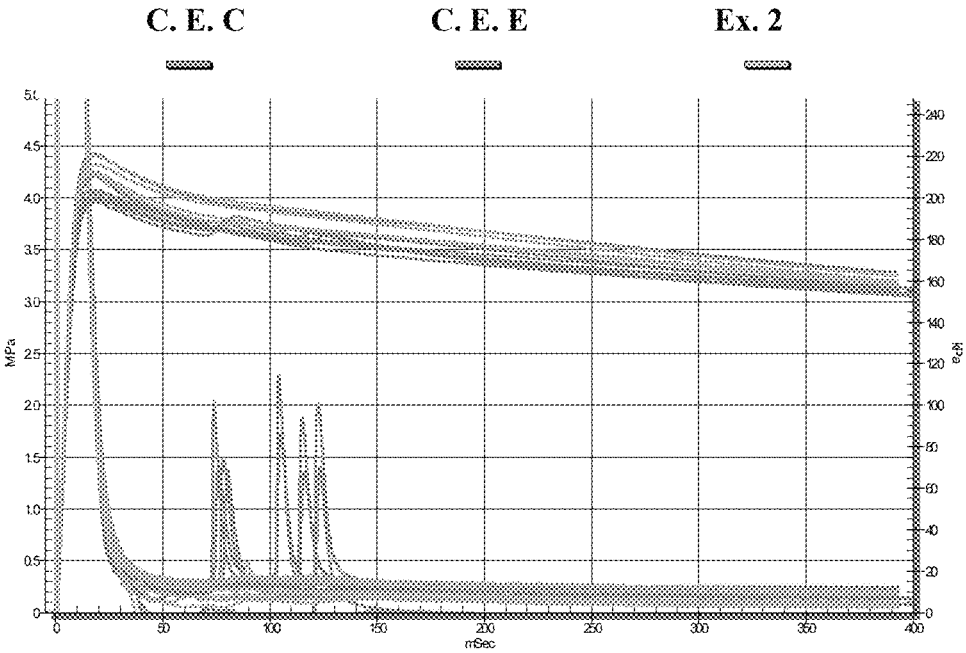

FIG. 3 shows inflator performance having a Type B Filter at low temperatures (e.g., −40° C.) with a third comparative example (Comparative Example C) of gas generant containing crystalline silicon dioxide ($SiO_2$), a fifth comparative example (Comparative Example E) having E-type glass fibers in the same gas generant, and Example 2 of the same gas generant having S-type glass fibers in accordance with various aspects of the present disclosure. Both Comparative Examples C and E exhibit distinct reignition peaks, while Example 2 shows no reignition with deployments.

Figure 4:
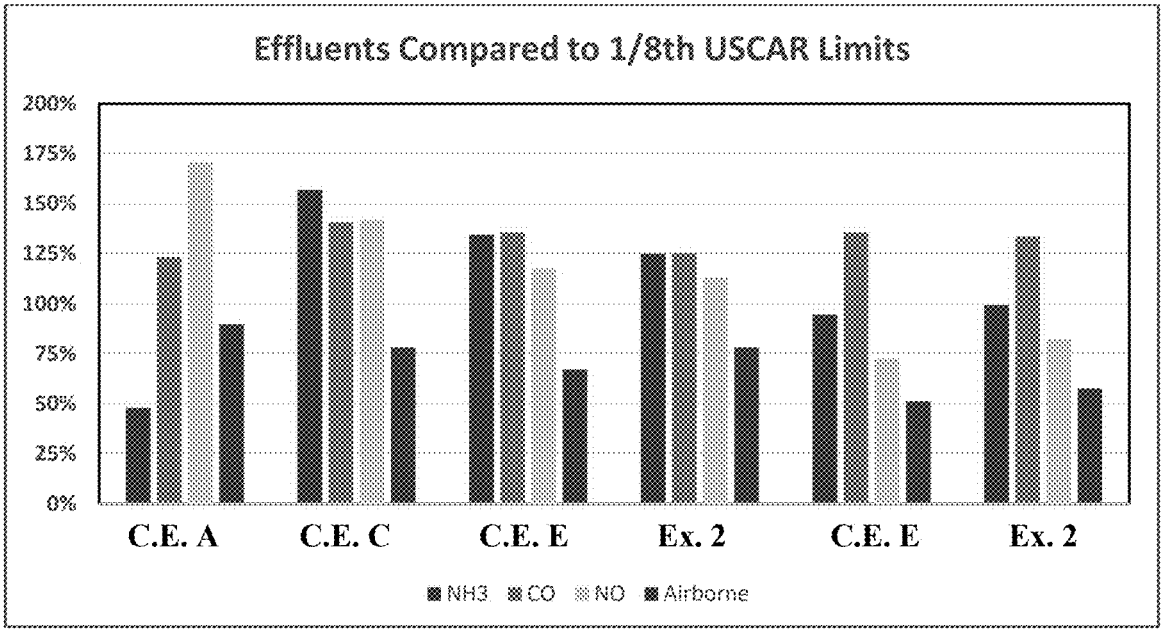

FIG. 4 shows a comparison of gas effluent as compared to $1/8^{th}$ of USCAR effluent limits when combusting a first comparative example (Comparative Example A) of gas generant containing E-glass fibers, a third comparative example (Comparative Example C) containing crystalline silicon dioxide ($SiO_2$) in the same gas generant, a fifth comparative example (Comparative Example E) having the same gas generant and an E-glass fiber, where combustion effluents are compared with an inventive Example 2 of the same gas generant having S-type glass fibers in accordance with various aspects of the present disclosure. The first four results (Comparative Examples A, E, and E and inventive Example 2) are from an inflator having a Type A filter, while the second final results (Comparative Example E and inventive Example 2) are in an inflator with a Type B filter.

Corresponding reference numerals indicate corresponding parts throughout the several views of the drawings.

DETAILED DESCRIPTION

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood in certain embodiments as being modified by the term "about" whether or not "about" actually appears before the numerical value, while in other embodiments, are precisely or exactly the value or parameter specified. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%. By way of example, if a range is specified to be greater than or equal to about A to less than or equal to about B, this encompasses not only the stated range, but also a range that includes greater than or equal to exactly A to less than or equal to exactly B, as well greater than exactly A to less than exactly B in other embodiments.

In addition, disclosure of ranges includes disclosure of all values and further subdivided ranges within the entire range, including endpoints and sub-ranges given for the ranges. Further, each specified value or endpoint can define a maximum value or upper bound (for example, specifying greater than 0 to the maximum value) or a minimum value or lower bound (for example, specifying the minimum value to 100).

As used herein, unless otherwise indicated, amounts expressed in weight and mass are used interchangeably, but should be understood to reflect a mass of a given component.

As used herein, the terms "composition" and "material" are used interchangeably to refer broadly to a substance containing at least the preferred chemical constituents, elements, or compounds, but which may also comprise additional elements, compounds, or substances, including trace amounts of impurities, unless otherwise indicated.

Example embodiments will now be described more fully with reference to the accompanying drawings.

The present disclosure contemplates a pyrotechnic gas generant composition that can be in the form of a solid grain, a pellet, a tablet, or the like. As the gas generant burns it creates a gas or effluent for inflation that is directed to an inflating device (e.g., airbag) within the inflatable restraint system. Various different gas generant compositions are used in vehicular occupant inflatable restraint systems. Gas generant material selection involves various factors, including meeting current industry performance specifications, guidelines and standards, generating safe gases or effluents, handling safety of the gas generant materials, durational stability of the materials, and cost-effectiveness in manufacture, among other considerations. It is preferred that the gas generant compositions are safe during handling, storage, and disposal, and preferably are azide-free.

The gas generant typically includes at least one fuel component and at least one oxidizer component, and may include other minor ingredients, that once ignited combust rapidly to form gaseous reaction products (e.g., $CO_2$, $H_2O$, and $N_2$). One or more fuel compounds undergo rapid combustion to form heat and gaseous products; e.g., the gas generant burns to create heated inflation gas for an inflatable restraint device or to actuate a piston. The gas-generating composition also includes one or more oxidizing components, where the oxidizing component reacts with the fuel component in order to generate the gas product.

One way of optimizing gas generant performance and reducing system cost of gas generants for passive restraint systems is to reduce the combustion flame temperature of the gas generant formulation. In addition to combustion flame temperature, as noted above, other important gas generant characteristics that help to improve the performance and efficiency of the inflator may include increased linear burn rate ($r_b$) and gas yield of the gas generant.

In various aspects, the present disclosure provides a relatively cool burning gas generant composition that has a relatively high burning rate (referred to herein as "fast and cool"). In certain aspects of the present disclosure, a maximum flame temperature at combustion ($T_c$) for a fast and cool gas generating composition, suitable for use in a side inflatable restraint system, is in the range of greater than or equal to about 1800K (about 1,527° C.) to 2100K (about 1,827° C.), optionally at less than or equal to about 2050K (about 1,777° C.), and in certain aspects, optionally at less than or equal to about 2000K (about 1,727° C.). In certain variations, a maximum flame temperature at combustion ($T_c$) for a fast and cool gas generating composition may be greater than or equal to about 1800K (about 1527° C.) to less than or equal to about 2050K (about 1,777° C.). Thus, in certain aspects, depending on the application, a high flame temperature (maximum flame temperature at combustion ($T_c$)) may be considered anything in excess of about 2100K (about 1,827° C.), optionally a maximum flame temperature at combustion ($T_c$) at greater than or equal to about 2050K (about 1,777° C.), and optionally greater than or equal to about 2000K (about 1,727° C.).

To mitigate the effects of high flame temperatures, the inflator may include a heat sink that may also serve as a filter or screen for the inflator. However, a significant portion of the mass of the inflator is often relegated to incorporation of the heat sink, which can impact the efficiency of the system and, more significantly, the weight of the inflator. In view of the above, a gas generating composition is contemplated for a side inflatable restraint system that can achieve a high gas output at a high mass flow rate at relatively low flame temperatures (e.g., less than approximately 2100K, optionally less than approximately 2050K, and in certain aspects, less than approximately 2000K). It will be appreciated by those of skill in the art that a maximum flame temperature at combustion ($T_c$) may vary based on the ultimate inflatable restraint system application, such that a high flame temperature for a front application may be considered to be relatively lower, as compared to a side inflatable restraint application.

Thus, in accordance with various aspects of the present disclosure, a gas generant composition is provided that has a volumetric gas yield of optionally greater than or equal to about 5.7 moles/100 $cm^3$ of gas generant. The product of gravimetric gas yield and density is a volumetric gas yield. In other embodiments, the volumetric gas yield is greater than or equal to about 5.9 moles/100 $cm^3$ of gas generant, optionally greater than or equal to about 6.0 moles/100 $cm^3$ of gas generant, optionally greater than or equal to about 6.1 moles/100 $cm^3$ of gas generant, and in certain variations, optionally greater than or equal to about 6.2 moles/100 $cm^3$ of gas generant.

In addition to gas generant performance with respect to volumetric gas yield, relative quickness as determined by observed burning rate is also important in inflator gas generant design. In general, a burn rate for a gas generant composition can be represented by a simplified equation:

$$rb = k(P)^n \quad \text{(Eqn. 1)}$$

where $r_b$ is burn rate (linear); k is a constant; P is pressure, and n is a pressure exponent, where the pressure exponent is the slope of a linear regression line drawn through the log-log plot of linear burn rate ($r_b$) versus pressure (P).

In various embodiments, the gas generant has a desirably high burning rate which enables desirable pressure curves for inflation of an airbag within a predetermined timeframe. A linear burn rate "$r_b$" for a gas generant material may be expressed in length per time at a given pressure. In accordance with various aspects of the present disclosure, the gas generant has a linear burn rate of greater than or equal to about 20 mm per second at a pressure of about 20 megapascals (MPa). The burn rate may optionally be greater than or equal to about 21 mm per second at a pressure of about 20 MPa, optionally greater than or equal to about 22 mm per second at a pressure of about 20 MPa, optionally greater than or equal to about 23 mm per second at a pressure of about 20 MPa, optionally greater than or equal to about 24 mm per second at a pressure of about 20 MPa, and in certain variations, optionally greater than or equal to about 25 mm per second at a pressure of about 20 MPa. In certain further embodiments, the linear burn rate for the gas generant may be greater than or equal to about 50 mm per second at a pressure of about 40 megapascals (MPa), optionally greater than or equal to about 51 mm per second at a pressure of about 40 MPa, optionally greater than or equal to about 52 mm per second at a pressure of about 40 MPa, optionally greater than or equal to about 53 mm per second at a pressure of about 40 MPa, optionally greater than or equal to about 54 mm per second at a pressure of about 40 MPa, and in certain variations, optionally greater than or equal to about 55 mm per second at a pressure of about 40 MPa.

In various aspects, such cool and fast gas generating compositions may include at least two distinct fuel components and at least two distinct oxidizer components, along with other optional minor ingredients, that once ignited combust rapidly to form gaseous reaction products (e.g., $CO_2$, $H_2O$, and $N_2$). One or more fuel compounds undergo rapid combustion to form heat and gaseous products; e.g., the gas generant burns to create heated inflation gas for an inflatable restraint device or to actuate a piston. The gas-generating composition also includes one or more oxidizing components, where the oxidizing component reacts with the fuel component in order to generate the gas product. The cool and fast gas generating composition provided by certain aspects of the present disclosure may thus include a gas generating composition having at least one primary oxidizer, at least one secondary oxidizer, at least one primary fuel, and at least one secondary fuel. It is understood that while general attributes of each of the categories of pyrotechnic components described herein may differ, there may be some common attributes and any given material may serve multiple purposes within two or more of such categories of pyrotechnic active components. Thus, classification or discussion of a material within this disclosure as having a particular utility is made for convenience, and no inference should be drawn that the material must necessarily or solely function in accordance with its classification herein when it is used in any given composition. For example, fuels may be categorized as such due to their relatively low burn rates and are often combined with one or more oxidizers having relatively greater burn rates to achieve a desired overall burn rate and gas production for the gas generating composition.

The gas generant composition may also include various optional additives. By way of example, the gas generant may further comprise a pyrotechnic component selected from the group consisting of: auto-ignition materials, binders, slag forming agents, coolants, flow aids, viscosity modifiers, dispersing aids, phlegmatizing agents, excipients, burning rate modifying agents, and combinations thereof.

In certain variations and as will be described further below, a particularly suitable fast and cool burning gas generant material for a side impact inflator system comprises at least one primary oxidizer, for example, basic copper nitrate, at least one secondary oxidizer, for example, potassium perchlorate, at least one primary fuel, for example, guanidine nitrate (GN), and at least one secondary fuel, for example, melamine nitrate. Various formulations of such a gas generant can advantageously meet temperature and burning rate requirements for a side-impact inflatable restraint system and further may be compatible with a polyethylene terephthalate (PET) cushion material.

However, in certain applications and with certain conditions, combustion of select gas generants has resulted in significant combustion instability, for example, manifesting as extinguishment and reignition behavior. For example, certain fast and cool burning gas generants can suffer from extinction/extinguishment of the flame, which may in some variations be accompanied by one or more reignition events. Stated in another way, certain gas generants may extinguish and potentially re-ignite and burn, exacerbating undesirable effects. Notably, many conventional gas generants do not suffer from such combustion instability due to flame extinguishment or reignition behavior and any associated pressure excursions when combusted in conventional inflators for passive restraint systems. Combustion instability from extinction/reignition differs from traditional pressure sensitivity of gas generants, for example, having a linear burn rate that is susceptible to pressure sensitivity during combustion and related concerns. General pressure sensitivity ("n" in Eqn. 1 above) is a common trait to all gas generant formulations; however, sustained combustion is assumed to occur for most gas generants. With certain gas generant formulations, for example, those having basic copper nitrate and guanidine nitrate along with potassium perchlorate that provide an accelerated burning rate, a predetermined minimum pressure needs to be reached in the combustion chamber before sustained combustion occurs. Extinguishment of some gas generant formulations can occur when an abrupt drop in pressure happens, for example, when the containment vessel of the gas generant opens and exposes the combustion gases to a larger containment volume. Reignition can then occur if and when the pressure and heat in the expanded volume sufficiently increases. Thus, in various aspects, a slagging agent in the form of an S-type glass fibers or other equivalents serves to improve combustion stability of the gas generant.

By way of example, such combustion instability can result in multiple pressure spikes in the combustion trace after approximately 300 milliseconds, well after the primary inflation timeframe that typically occurs within 40 to 50 milliseconds. Reignition of gas generant after the main functioning of the inflator is undesirable given that gas produced after approximately 40 to 50 milliseconds is unusable and wasted. Further, increased formation of undesirable gaseous combustion products results from these reignitions, when low-pressure burning is present. Generally, a steady and continuous combustion process, substantially or entirely free of any flame extinguishment or flame reignition behavior is desirable, which eliminates any associated pressure excursions after the main inflation period of the gas generant and further eliminates intermittent combustion conditions, while the gas generant is burned to completion.

When a gas generant is combusted in a continuous process, where the combustion progresses without interruption of the flame, the combustion performance occurs within the predetermined timelines and designated targets, including for effluent production. As noted above, intermittent gas generant combustion suffering from extinguishment event(s) and/or reignition event(s), results in diminished performance that may fail to consistently meet combustion performance targets and further may generate undesirable effluent species S-Type Glass Fiber It has been discovered that introducing a specific glass fiber to the gas generant material, specifically, a S-type glass fiber, unexpectedly stabilizes combustion performance of gas generants that suffer from combustion instability. S-type glass fibers are especially advantageous in stabilizing the cool and fast gas generant compositions described herein for side impact inflatable restraint systems, which otherwise can suffer from significant flame extinguishment or flame reignition behavior and the pressure excursions associated therewith. As will be described further below, the S-type glass fibers confer the advantages of suppressing extinguishment and/or reignition events during combustion of gas generants and make such gas generants meet performance requirements, including reliability during combustion, for use in commercial applications. Notably other fibers, including other types of glass fibers, do not appear to adequately suppress or diminish extinguishment or reignition behavior and associated pressure excursions in the cool and fast burning gas generants.

S-type glass fibers are considered high-performance glass fibers having nominal compositions with higher contents of silicon oxide, aluminum oxide, and magnesium oxide, as compared to other glass fibers, including E-type glass fibers. Thus, the overall oxide content of S-type glass compositions may be expressed as a comprising silicon dioxide at greater than or equal to about 60% by mass, optionally greater than or equal to about 61% by mass, aluminum oxide at greater than or equal to about 20% by mass, optionally greater than or equal to about 21% by mass, optionally greater than or equal to about 22% by mass, and magnesium oxide at greater than or equal to about 9% by mass. In one embodiment, the S-type glass fiber may comprise nominal amounts of the following oxides, silicon dioxide at greater than or equal to about 61% by mass, aluminum oxide at greater than or equal to about 23% by mass, magnesium oxide at greater than or equal to about 9% by mass, boron oxide at greater than or equal to about 4% by mass, calcium oxide at about 0.05% by mass, cumulative other oxides at about 0.06% by mass, and a balance impurities. The S-type glass fiber may be in a non-crystalline or amorphous form.

Thus, S-type glass fibers result in higher tensile strength, higher modulus of elasticity, greater stiffness/higher elongation, among other properties compared to E-type glass. In certain variations, the S-type glass fibers may have a modulus of elasticity of greater than or equal to about 85 MPa, a tensile strength of greater than or equal to about 4,000 MPa, optionally greater than or equal to about 4,500 MPa, and a percent elongation of greater than or equal to about 5%. A density of the S-type glass fibers may be greater than or equal to about 2,400 kg/m$^3$, optionally greater than or equal to about 2,414 kg/m$^3$, optionally greater than or equal to about 2,600 kg/m$^3$, and optionally greater than or equal to about 2,614 kg/m$^3$.

The S-type glass fiber advantageously has a relatively high thermal softening point or thermal decomposition temperature ($T_d$), for example, greater than or equal to about 1,000° C., optionally greater than or equal to about 1,100° C., optionally greater than or equal to about 1,200° C., and optionally greater than or equal to about 1,300° C. As will be described further herein, without being bound by any particular theory, it is believed that the higher thermal softening point leads to the glass fibers serving as more efficient slagging agents than other slagging agents or fibers. Generally, a slagging agent melts at combustion flame temperatures and physically traps solid combustion products inside the inflator by agglomerating solid particles into a larger, more easily filtered, mass. A side benefit of a good slagging agent is that it traps and holds solid burning particles at the burning surface of the gas generant, improving heat feedback and improving combustion stability. It is believed that the S-type glass fibers serve as slagging agents by softening and transforming to a viscous molten phase, which depending on the maximum flame temperature may not be entirely liquid, which retains heat better at the surface and thus serves to stabilize combustion of an otherwise unstable gas generant by more efficiently serving the role of a slagging agent. Thus, S-type glass can act as a combustion stabilizer through improved slag formation and retention of the hot solid combustion products at the surface of the burning gas generant. The viscosity of the softened glass fibers decreases with increased temperature. The cohesive forces (stickiness) also decrease with temperature, so a fiber having a higher softening temperature is stickier than the fiber with a lower softening point, assuming both fibers softening points are less than the combustion flame temperature.

Glass can be manufactured into fibers, including continuous, semi-continuous, or blown fibers. Various methods of forming fibers include spinning, direct melt, or marble melt processes where a molten glass stream is spun or can be passed through an orifice and is cooled to form continuous fibers. Glass fibers for use in accordance with the present disclosure can be formed by using conventional methods and equipment. For example, the glass compositions can be formed into fibers by way of various conventional glass fiber manufacturing processes, such as rotary, CAT, modified rotary processes, flame blown processes, and strand or continuous filament glass fiber processes. Further, the S-type glass fibers used herein may be in a chopped or milled form, for example, having been milled in conventional milling equipment. Milled glass fibers are particularly suitable for use in conjunction with the present teachings. By way of example, glass fibers can be hammer-milled to various densities, thus, in certain aspects, the S-type glass fibers comprise milled glass fibers, such as microglass milled fibers.

As used herein, a glass fiber has an axial geometry with an aspect ratio (AR) of greater than or equal to about 2:1. Generally, an aspect ratio (AR) for cylindrical shapes (e.g., a rod or fiber) is defined as AR=L/D where L is the length of the longest dimension and D is the diameter of the cylinder or fiber. Exemplary glass fiber particles suitable for use in the present disclosure generally have relatively high aspect ratios, optionally ranging from about 5:1 to about 50:1, optionally ranging from about 10:1 to about 50:1, and in certain aspects having an aspect ratio of about 10:1 to about 20:1, by way of example. In certain aspects, an average diameter of the glass fibers is greater than or equal to about 2 micrometers to less than or equal to about 50 micrometers, optionally greater than or equal to about 5 micrometers and less than or equal to about 50 micrometers, and optionally greater than or equal to about 10 micrometers and less than or equal to about 50 micrometers. In certain aspects, an average length (i.e., longest dimension) of the glass fiber(s) is greater than or equal to about 10 micrometers (μm), optionally greater than or equal to about 50 micrometers, and in certain aspects, optionally greater than or equal to about 60 micrometers. For example, in certain variations, an average length of the glass fiber may be greater than or equal to about 50 micrometers to less than or equal to about 240 micrometers, optionally greater than or equal to about 60 micrometers to less than or equal to about 260 micrometers. In certain embodiments, the dimensions of the glass fibers used in accordance with the present disclosure may range from about 6 micrometers to about 13 micrometers in diameter and about 60 micrometers to about 260 micrometers in length. In yet other aspects, the length of the glass fibers, for example, milled glass fibers, is greater than or equal to about 3 micrometers and less than or equal to about 600 micrometers.

As will be appreciated, in alternative variations, the present disclosure contemplates use of alternative high performance glass fibers that provide similar combustion stability and performance advantages to the gas generant compositions described herein, but may vary somewhat from a glass fiber categorized as an S-Type glass fiber in composition or other stated properties described above. Thus, in such alternative variations, reference to an S-Type glass fiber throughout the disclosure is understood to encompass other high performance glass fibers, which may not be strictly classified as an S-type glass fiber.

In certain variations, the gas generant grain comprises a plurality of S-Type glass fibers distributed in the material at greater than or equal to about 1% and less than about 10% by weight of the gas generant composition, optionally greater than or equal to about 1% to less than or equal to about 5% by weight, and in certain variations, optionally greater than or equal to about 1% to less than or equal to about 3% by weight of the overall gas generant composition.

In various aspects, the present disclosure contemplates a gas generant composition comprising at least one fuel, at least one oxidizer, and a plurality of S-type glass fibers. As discussed above, the gas generating compositions may include combinations of fuels, such that the fuels may be nominally considered a primary fuel, a second fuel, and the like. In certain variations, the at least one fuel includes a primary fuel and a secondary fuel (or co-fuel). Likewise, the at least one oxidizer may include a primary oxidizer and a secondary oxidizer.

Primary Fuel

The gas generant compositions may include at least one primary fuel. Examples of primary fuels may include nitrogen-containing organic compounds. In specific examples, the nitrogen-containing organic compound may be guanidine or a guanidine derivative. The guanidine derivative can be selected from nitroguanidine, guanidine or guanidinium nitrate, aminoguanidine, aminoguanidine nitrate, copper bis guyanylurea dinitrate (CuGUN), biguanide dinitrate, and aminoguanidine hydrogen carbonate. Other examples of primary fuels include tetrazole or a tetrazole derivative selected from aminotetrazole, bitetrazole, azobitetrazole, nitrotetrazole, and nitroaminotetrazole. Other fuels may include triazoles, imidazoles, melamine, melamine nitrate, and transition metal salts of these compounds, and transition metal nitrate and perchlorate complexes of the compounds. Although more than one primary fuel can be used, in certain variations, the primary fuel at least includes guanidine nitrate (GN).

The at least one primary fuel may be present at amounts that range between greater than or equal to about 35% to less than or equal to about 55% by weight of an overall gas generating composition, optionally greater than or equal to about 40% to less than or equal to about 55% by weight, and in certain variations, optionally greater than or equal to about 45% to less than or equal to about 55% by weight of the overall gas generating composition.

Secondary Fuel

The gas generant compositions may include at least one secondary fuel (or co-fuel). Any of the above-noted primary fuels may be used as the secondary fuel, albeit at a reduced amount in comparison to an amount of the primary fuel. However, in certain variations, the secondary fuel at least includes melamine nitrate.

The at least one secondary fuel may be present at amounts that range between greater than or equal to about 1 to less than or equal to about 20% by weight of an overall gas generating composition, optionally greater than or equal to about 2% to less than or equal to about 15% by weight, and in certain aspects, optionally greater than or equal to about 5% to less than or equal to about 15% by weight.

Primary Oxidizer

The gas generant compositions may include at least one primary oxidizer. One or more oxidizers are selected along with the fuel components to form a gas generant that upon combustion achieves an effectively high burn rate and gas yield from the fuel. The gas generating compositions may include combinations of oxidizers, such that the oxidizers may be nominally considered a primary oxidizer, a second oxidizer, and the like. Examples of primary oxidizers that may be used in the gas generating compositions of the present disclosure include metal nitrates, perchlorates, basic metal nitrates, transition metal oxides, and the like.

Generally, suitable basic metal nitrate compounds include basic metal nitrates, basic transition metal nitrate hydroxy double salts, basic transition metal nitrate layered double hydroxides, and mixtures thereof. Suitable examples of basic metal nitrates include, but are not limited to, a basic copper nitrate, a basic zinc nitrate, a basic cobalt nitrate, a basic iron nitrate, a basic manganese nitrate, a basic molybdenum nitrate, a basic bismuth nitrate, a basic cerium nitrate, and mixtures thereof. In certain aspects, the at least one primary oxidizer includes a basic metal nitrate. Although more than one primary oxidizer can be used, in certain variations, the primary oxidizer at least include a basic copper nitrate (BCN).

In certain variations, an amount of primary oxidizer in the gas generating composition may range between greater than or equal to about 25 to less than or equal to about 50% by weight, optionally greater than or equal to about 30 to less than or equal to about 40% by weight, and optionally greater than or equal to about 35 to less than or equal to about 50% by weight of the gas generating composition.

Secondary Oxidizer

The gas generant compositions may include at least one secondary oxidizer. Suitable secondary oxidizers for the gas generating compositions include, by way of non-limiting example, alkali metal (e.g., elements of Group 1 of IUPAC Periodic Table, including Li, Na, K, Rb, and/or Cs), alkaline earth metal (e.g., elements of Group 2 of IUPAC Periodic Table, including Be, Ng, Ca, Sr, and/or Ba), and ammonium nitrates, nitrites, and perchlorates; metal oxides (including Cu, Mo, Fe, Bi, La, and the like); basic metal nitrates (e.g., elements of transition metals of Row 4 of IUPAC Periodic Table, including Mn, Fe, Co, Cu, and/or Zn); transition metal complexes of ammonium nitrate (e.g., elements selected from Groups 3-12 of the IUPAC Periodic Table); metal ammine nitrates, metal hydroxides, and combinations thereof. Examples of secondary oxidizers include alkali metal and alkaline earth metal salts of perchloric acid. Specific examples of these materials that are suitable for use herein include ammonium perchlorate, sodium perchlorate, potassium perchlorate, magnesium perchlorate, and barium perchlorate. Although more than one secondary oxidizer can be used, in certain variations, the secondary oxidizer at least includes potassium perchlorate.

The at least one secondary oxidizer may be present at amounts that range between greater than or equal to about 1% to less than or equal to about 20% by weight of an overall gas generating composition, optionally greater than or equal to about 5% to less than or equal to about 20% by weight, and optionally greater than or equal to about 5% to less than or equal to about 15% by weight of the overall gas generating composition.

Additives

Although not required, the gas generating composition according to the present disclosure may contain at least one additive. If desired, a cumulative total amount of additive(s) contained in the gas generating compositions may be up to about 11%, optionally less than or equal to about 10% by weight of the gas generant composition. Additives may be used to cool gas temperature, improve effluents, improve binding, and improve powder flow, by way of example. Additives for lubrication (e.g., press aids) can also optionally be added, which may permit improved powder flow during processing and pressing, and improve slagging.

Additives that may be used as a coolant to lower gas temperatures include materials such as carbonates, like calcium carbonate, magnesium carbonate, or aluminum hydroxide, and other suitable coolants.

Additives that may be used as a press aid include lubricants and/or release agents such as molybdenum disulfide and graphite, metal salts of fatty acids such as calcium stearate and magnesium stearate, mica, and/or graphitic boron nitride, by way of non-limiting example. If used as an additive, press aids may be present in the gas generating compositions in amounts up to about 1% by weight.

As S-type glass fiber is included in the present gas generant compositions, it is not believed that additional slagging agents will be required. However, traditional slagging agents may further be included with the s-type glass fibers, if required. Such slagging agents may include metal oxides such as aluminum oxide, silicon dioxide, cerium oxide, ferric oxide, zinc oxide, titanium oxide, zirconium oxide, bismuth oxide, molybdenum oxide, lanthanum oxide, E-type glass, and the like. Metal hydroxides such as aluminum hydroxide and other metal hydroxides known to one skilled in the art may also be used as an additive to improve slag. If used as an additive, additional slag generating agents may be present in the gas generating compositions in amounts up to about 10% by weight.

In various aspects, the present disclosure contemplates a gas generating composition comprising at least one fuel (or fuels) present at greater than or equal to about 20% to less than or equal to about 60% by weight, optionally greater than or equal to about 25% to less than or equal to about 60% by weight, optionally greater than or equal to about 30% to less than or equal to about 50% by weight, or alternatively, optionally greater than or equal to about 20% to less than or equal to about 55% by weight, optionally greater than or equal to about 25% to less than or equal to about 50% by weight. The gas generant composition also comprises at least one oxidizer (or oxidizers) present at greater than or equal to about 25% to less than or equal to about 65% by weight, optionally greater than or equal to about 35% to less than or equal to about 65% by weight. The gas generant composition further comprises a plurality of S-type glass fibers present at greater than 0% to less than or equal to about 10% by weight, and one or more additives cumulatively present at greater than 0% to less than or equal to about 10% by weight.

In certain aspects, the present disclosure contemplates a gas generant having a primary fuel, for example, guanidine nitrate, a secondary fuel, for example, melamine nitrate, a primary oxidizer, for example, basic copper nitrate, and a secondary oxidizer, for example, potassium perchlorate. In certain variations, the gas generating composition comprises the secondary fuel at greater than or equal to about 1% to less than or equal to about 20% by weight and the secondary oxidizer at greater than or equal to about 5% to less than or equal to about 20% by weight. For example, a particularly suitable gas generating composition comprises the primary fuel (for example, guanidine nitrate) at greater than or equal to about 20% to less than or equal to about 60% by weight, optionally greater than or equal to about 25% to less than or equal to about 60% by weight, optionally greater than or equal to about 30% to less than or equal to about 50% by weight, or alternatively, optionally greater than or equal to about 20% to less than or equal to about 55% by weight, optionally greater than or equal to about 25% to less than or equal to about 50% by weight of the gas generating composition. The secondary fuel (for example, melamine nitrate) may be present at greater than 0% to less than or equal to about 20% by weight, optionally greater than or equal to about 1% to less than or equal to about 20% by weight, optionally greater than 1% to less than or equal to about 15% by weight of the gas generating composition. The primary oxidizer (for example, basic copper nitrate) may be present at greater than or equal to about 20% to less than or equal to about 60% by weight, optionally greater than or equal to about 20% to less than or equal to about 50% by weight of the gas generating composition, and the secondary oxidizer (for example, potassium perchlorate) at greater than 0% to less than or equal to about 20% by weight, and optionally greater than or equal to about 5% to less than or equal to about 15% by weight of the gas generating composition. The S-type glass fibers may be present in the gas generant composition at greater than 1% to less than or equal to about 10% by weight and additional cumulative additives may be present at greater than 1% to less than or equal to about 10% by weight of the gas generant composition.

In certain aspects, a gas generant composition comprising a primary fuel, for example, guanidine nitrate, a secondary fuel, for example, melamine nitrate, a primary oxidizer, for example, basic copper nitrate, and a secondary oxidizer, for example, potassium perchlorate, and S-type glass fibers may have a maximum flame temperature at combustion ($T_c$) of less than or equal to about 2100K (1,827° C.), a linear burn rate of greater than or equal to about 20 mm per second at a pressure of about 20 megapascals (MPa), and a linear burn rate pressure exponent of less than or equal to about 0.45. In certain variations, such a gas generant composition may have a maximum flame temperature at combustion ($T_c$) of less than or equal to about 2050K (1,777° C.) or optionally less than or equal to about 2000K (1,727° C.). Likewise, such a gas generant composition may have a linear burn rate pressure exponent of less than or equal to about 0.42 and optionally less than or equal to about 0.4. In other variations, a linear burn rate for the gas generant composition may be greater than or equal to about 50 mm per second at a pressure of about 40 megapascals (MPa).

In one variation, the gas generant comprises a primary fuel comprising guanidine nitrate at greater than or equal to about 30% to less than or equal to about 60% by weight, a secondary fuel comprising melamine nitrate at greater than or equal to about 1% to less than or equal to about 20% by weight, a primary oxidizer comprising basic copper nitrate at greater than or equal to about 20% to less than or equal to about 50% by weight, a secondary oxidizer comprising potassium perchlorate at greater than or equal to about 5% to less than or equal to about 20% by weight, S-type glass fibers at greater than or equal to about 1% to less than or equal to about 10% by weight, and optional additives cumulatively present at less than or equal to about 10% by weight.

For example, a particularly suitable gas generating composition comprises the primary fuel (for example, guanidine nitrate) at greater than or equal to about 20% to less than or equal to about 60% by weight, optionally greater than or equal to about 30% to less than or equal to about 55% by weight, optionally greater than or equal to about 35% to less than or equal to about 50% by weight, of the gas generating composition. The secondary fuel (for example, melamine nitrate) may be present at greater than 0% to less than or equal to about 20% by weight, optionally greater than or equal to about 1% to less than or equal to about 20% by weight, optionally greater than 1% to less than or equal to about 15% by weight of the gas generating composition. The primary oxidizer (for example, basic copper nitrate) may be present at greater than or equal to about 20% to less than or equal to about 60% by weight, optionally greater than or equal to about 20% to less than or equal to about 50% by weight of the gas generating composition, and the secondary oxidizer (for example, potassium perchlorate) at greater than 0% to less than or equal to about 20% by weight, and optionally greater than or equal to about 5% to less than or equal to about 15% by weight of the gas generating composition. S-type glass fibers may be present in the gas generant at greater than or equal to about 1% to less than or equal to about 10% by weight, and optional additives cumulatively present at less than or equal to about 10% by weight In certain variations, such a gas generant composition may have a maximum flame temperature at combustion ($T_c$) of less than or equal to about 2050K (1,777° C.) or optionally less than or equal to about 2000K (1,727° C.). Likewise, such a gas generant composition may have a linear burn rate pressure exponent of less than or equal to about 0.45, optionally less than or equal to about 0.42, and optionally less than or equal to about 0.4. A linear burn rate ($R_b$) of the gas generant may be greater than or equal to about 20 mm per second at a pressure of about 20 megapascals (MPa), optionally greater than or equal to about 50 mm per second at a pressure of about 40 megapascals (MPa).

In certain variations, the present disclosure contemplates a gas generant composition that comprises a primary fuel, a secondary fuel comprising melamine nitrate at greater than or equal to about 1% by weight to less than or equal to about 20% by weight of the gas generant composition, a primary oxidizer, a secondary oxidizer comprising potassium perchlorate at greater than or equal to about 5% by weight to less than or equal to about 20% by weight of the gas generant composition, and a plurality of S-type glass fibers. Each S-type glass fiber comprises silicon dioxide at greater than or equal to about 60% by mass, aluminum oxide at greater than or equal to about 20% by mass, and magnesium oxide at greater than or equal to about 9% by mass and having a thermal softening point temperature ($T_d$) of greater than or equal to about 1,000° C. During combustion of the gas generant composition: (i) a linear burn rate may be greater than or equal to about 20 mm/second at 20 MPa, (ii) a burn rate slope may be less than or equal to about 0.45, and (iii) combustion may be substantially free of extinguishment or reignition behavior and any associated pressure excursions. In one aspect, the plurality of S-type glass fibers is present at greater than or equal to about 1% and less than about 10% by weight of the gas generant composition, optionally greater than or equal to about 1% by weight to less than or equal to about 5% by weight of the gas generant. In other variations, the (i) linear burn rate for the gas generant composition may be greater than or equal to about 50 mm per second at a pressure of about 40 megapascals (MPa).

In certain further aspects, the primary fuel comprises guanidine nitrate and is present at greater than or equal to about 20 to less than or equal to about 60 weight % of the total gas generant composition. Further, the primary oxidizer may comprise basic copper nitrate that is present at greater than or equal to about 20 to less than or equal to about 60 weight % of the total gas generant composition.

In one aspect, the thermal softening point temperature ($T_d$) of the plurality of S-type glass fibers is greater than or equal to about 1,300° C.

In certain aspects, during combustion, the gas generant may exhibit (ii) a burn rate slope is less than or equal to about 0.42 and (iii) a maximum flame temperature at combustion ($T_c$) of less than or equal to about 2100K. Each S-type glass fiber of the plurality of S-type glass fibers has an average aspect ratio (AR) ranging from about 10:1 to about 20:1 and has a length of greater than or equal to about 6 micrometers to less than or equal to about 260 micrometers.

In certain aspects, each S-type glass fiber of the plurality of S-type glass fibers has silicon dioxide at greater than or equal to about 61% by mass, aluminum oxide at greater than or equal to about 23% by mass, magnesium oxide at greater than or equal to about 9% by mass, boron oxide at greater than or equal to about 4% by mass, calcium oxide at 0 to 0.05% by mass, cumulative other oxides at about 0.06% by mass, and a balance impurities. Further, each S-type glass fiber may have a modulus of elasticity of greater than or equal to about 85 MPa, a tensile strength of greater than or equal to about 4,500 MPa, a percent elongation of greater than or equal to about 5%, and a density of greater than or equal to about 2,400 kg/m$^3$.

In one aspect, the burn rate slope of the gas generant is less than or equal to about 0.42.

In further aspects, a gas generant composition is contemplated that comprises a primary fuel comprising guanidine nitrate at greater than or equal to about 20 to less than or equal to about 60 weight % of the total gas generant composition, melamine nitrate at greater than or equal to about 1% by weight to less than or equal to about 20% by weight of the gas generant composition, a primary oxidizer comprising basic copper nitrate at greater than or equal to about 20 to less than or equal to about 60 weight % of the total gas generant composition, potassium perchlorate at greater than or equal to about 5% by weight to less than or equal to about 20% by weight of the gas generant composition, and a plurality of S-type glass fibers at greater than 0 to less than or equal to about 10 weight % of the total gas generant composition. Each S-type glass fiber comprises silicon dioxide at greater than or equal to about 60% by mass, aluminum oxide at greater than or equal to about 20% by mass, and magnesium oxide at greater than or equal to about 9% by mass and having a thermal softening point temperature ($T_d$) of greater than or equal to about 1,000° C. Further, the gas generant may optionally comprise one or more additives cumulatively present at greater than or equal to 0% to less than or equal to about 10% by weight of the gas generant composition. During combustion of the gas generant composition: (i) a linear burn rate is greater than or equal to about 20 mm/second at 20 MPa, (ii) a burn rate slope is less than or equal to about 0.45, (iii) a maximum flame temperature at combustion ($T_c$) of less than or equal to about 2100K, and (iv) combustion is substantially free of extinguishment or reignition behavior and any associated pressure excursions. In certain variations, the linear burn rate may be greater than or equal to about 50 mm per second at a pressure of about 40 megapascals (MPa).

In other variations, the present disclosure contemplates a method for reducing combustion instability due to flame extinguishment and/or reignition in a gas generant for a side-impact inflatable restraint system. The method may comprise introducing a plurality of S-type glass fibers into a mixture comprising at least one fuel and at least one oxidizer to form the gas generant, such as any of the mixtures described previously above. Each S-type glass fiber comprises silicon dioxide at greater than or equal to about 60% by mass, aluminum oxide at greater than or equal to about 20% by mass, and magnesium oxide at greater than or equal to about 9% by mass, and has a thermal softening point temperature ($T_d$) of greater than or equal to about 1,000° C. The mixture exhibits flame extinguishment and/or reignition during combustion when the plurality of S-type glass fibers is absent; however, the combusting of the gas generant comprising plurality of the S-type glass fibers is substantially free of flame extinguishment and/or reignition behavior and any associated pressure excursions.

In one aspect, an amount of S-type glass fibers in the gas generant after the introducing is less than or equal to about 10% by weight of the gas generant, optionally greater than or equal to about 1% by weight to less than or equal to about 5% by weight of the gas generant.

In one aspect, the thermal softening point temperature ($T_d$) of the plurality of S-type glass fibers is greater than or equal to about 1,300° C.

In one aspect, the combusting of the gas generant is substantially completed in less than or equal to about 50 milliseconds. Substantial completion of combustion can also be understood where greater than about 99% of the gas generant has undergone combustion.

In one aspect, the combusting of the gas generant occurs at a temperature of −40° C.

In one aspect, the at least one fuel comprises a primary fuel and a secondary fuel comprising melamine nitrate at greater than or equal to about 1% by weight to less than or equal to about 20% by weight of the gas generant. Further, the at least one oxidizer comprises a primary oxidizer and at least one secondary oxidizer comprising potassium perchlorate at greater than or equal to about 5% by weight to less than or equal to about 20% by weight of the gas generant. During the combusting, the gas generant exhibits (i) a linear burn rate of greater than or equal to about 20 mm/second at 20 MPa, (ii) a burn rate slope is less than or equal to about 0.45, (iii) a maximum flame temperature at combustion ($T_c$) is less than or equal to about 2100K. In other variations, the (i) linear burn rate for the gas generant composition may be greater than or equal to about 50 mm per second at a pressure of about 40 megapascals (MPa).

In one further aspect, the primary fuel comprises guanidine nitrate at greater than or equal to about 20% by weight to less than or equal to about 60% by weight of the gas generant and the primary oxidizer comprises basic copper nitrate at greater than or equal to about 20% by weight to less than or equal to about 60% by weight of the gas generant, or any of the amount previously specified above.

In certain aspects, each S-type glass fiber of the plurality of S-type glass fibers has an average aspect ratio (AR) ranging from about 10:1 to about 20:1 and has a length of greater than or equal to about 6 micrometers to less than or equal to about 260 micrometers.

In certain aspects, each S-type glass fiber of the plurality of S-type glass fibers has silicon dioxide at greater than or equal to about 61% by mass, aluminum oxide at greater than or equal to about 23% by mass, magnesium oxide at greater than or equal to about 9% by mass, boron oxide at greater than or equal to about 4% by mass, calcium oxide at about 0.05% by mass, cumulative other oxides at about 0.06% by mass, and a balance impurities. Further, each S-type glass fiber may have a modulus of elasticity of greater than or equal to about 85 MPa, a tensile strength of greater than or equal to about 4,500 MPa, a percent elongation of greater than or equal to about 5%, and a density of greater than or equal to about 2,400 kg/m$^3$.

Various embodiments of the inventive technology can be further understood by the specific examples contained herein. Specific examples are provided for illustrative purposes of how to make and use the compositions, devices, and methods according to the present teachings and, unless explicitly stated otherwise, are not intended to be a representation that given embodiments of this invention have, or have not, been made or tested.

EXAMPLES

Various formulations reflected in Table 1 with approximate nominal amounts of the components in weight of total gas generant composition are used in the following examples, as described further herein.

TABLE 1

| | $GuNO_3$ (%) | KP (%) | bCN (%) | $MeINO_3$ (%) | Copper guanylurea nitrate (%) | $Al_2O_3$, FCI precip (%) | Ca stearate (%) | S-glass (%) | E-glass (%) | Minusil 40 ™ ($SiO_2$) (%) |
|---|---|---|---|---|---|---|---|---|---|---|
| Comp. Ex. A | 48 | 12.5 | 28.5 | 0 | 9.6 | 0 | 0.25 | 0 | 1.2 | 0 |
| Comp. Ex. B | 34 | 12.5 | 35.7 | 15 | 0 | 0.5 | 0.25 | 0 | 2 | 0 |
| Comp. Ex. C | 45 | 12.5 | 29.8 | 10 | 0 | 0.5 | 0.25 | 0 | 0 | 2 |
| Comp. Ex. D | 40 | 6.6 | 43.3 | 7 | 0 | 0.5 | 0.25 | 0 | 2 | 0 |
| Comp. Ex. E | 45 | 12.5 | 29.8 | 10 | 0 | 0.5 | 0.25 | 0 | 2 | 0 |
| Ex. 1 | 40 | 6.6 | 43.3 | 7 | 0 | 0.5 | 0.25 | 2 | 0 | 0 |
| Ex. 2 | 45 | 12.5 | 29.8 | 10 | 0 | 0.5 | 0.25 | 2 | 0 | 0 |

Inflators were deployed where a cool and fast burning gas generant formulation was used as a base There are two inventive gas generants (Examples 1 and 2) prepared in accordance with certain aspects of the present disclosure that include S-type glass fibers. There are five comparative examples of conventional gas generant compositions (Comparative Examples A, B, C, D, and E). $GuNO_3$ is guanidine nitrate is used as a primary fuel, KP is potassium perchlorate is used as a secondary oxidizer, bCN is basic copper nitrate provided as a primary oxidizer, $MelNO_3$ is melamine nitrate provided as a secondary fuel, $Al_2O_3$ is aluminum oxide as a metal oxide/slag promoting additive, Ca stearate is calcium stearate as a press/lubrication aid additive, while Minusil 40™ is a silicon dioxide particle.

Example 1

In one Comparative Example C, the base gas generant further contains a crystalline silicon dioxide additive as a slagging/combustion air additive, which was compared to base gas generants where the silicon dioxide was replaced with E-glass fibers (Comparative Examples A and B). Reignitions were observed for the silicon dioxide (Comparative Example C) at both ambient and cold conditions (−40° C.). When crystalline $SiO_2$ was replaced with E-glass fibers. substituting silicon dioxide with such E-glass fibers was not effective in resolving reignition for Comparative Examples A and B. Reignition peaks remained visible in both formulations of Comparative Examples A and B as shown in FIG. 1, both at ambient and cold conditions.

Example 2

In another example, an S-type glass fiber (Example 1 in Table 1) was used in the same cool and fast burning gas generant formulation base and used in an inflator. This S-type glass fiber was compared to an E-type glass fiber in the gas generant suffering from reignition. S-glass fibers differ in chemical composition and consequently physical properties when compared to E-glass fibers, as shown in the samples below in Table 2. A significant chemical difference of S-type glass is that it contains elevated levels of aluminum oxide and magnesium oxide, as compared to E-type glass, as shown in Table 2.

TABLE 2

| | E-glass | S-glass |
|---|---|---|
| % $SiO_2$ | 53.39 | 61.90 |
| % $Al_2O_3$ | 13.84 | 23.33 |
| % $B_2O_3$ | 7.41 | 4.97 |
| % CaO | 20.27 | 0.05 |
| % MgO | 2.47 | 9.69 |
| Other oxides | 2.62 | 0.06 |
| $T_g$ glass transition temp (° C.) | 694 (measured) | TBD |
| $T_d$ softening point (° C.) | 739 (measured) | 1329 (lit value) |
| $\Delta H_{formation}$ (kJ/mole) | −1450 | −1565 |
| Density (kg/m$^3$) | 2580 | 2614 |

When a base gas generant had E-glass fibers (Comparative Example D) is substituted directly with S-glass fibers (Example 1), two separate instances the improvement of combustion stability were observed. The first example shown in FIG. 2 compares combustion pressure traces from Comparative Example D containing E-glass fibers to Example 1 containing S-glass fibers. Comparative Example D (E-glass additive) shows a distinct reignition peak between 20 and 30 milliseconds during low-temperature (LT) deployment while Example 1 prepared in accordance with certain aspects of the present disclosure (S-glass additive) shows no reignition events at cold temperatures (−40° C.).

Example 3

In another example shown in FIG. 3, combustion pressure traces from Comparative Example C (having $SiO_2$ additive), Comparative Example E (E-glass additive) and Example 2 (S-glass additive) were compared. Both Comparative Examples C and E showed distinct combustion instability during cold inflator deployments in the inflator, while Example 1 with the S-glass showed no reignition.

As noted above, while not limiting to any particular theory, it is believed that the improved combustion stability delivered by S-glass is because it functions as a more efficient slagging agent. The purpose of a slagging agent is to melt at combustion flame temperatures and physically trap solid combustion products inside the inflator by agglomerating solid particles into a larger, more easily filtered, mass. A side benefit of a good slagging agent is that it traps and holds solid burning particles at the burning surface of the gas generant, improving heat feedback and improving combustion stability. S-glass has been observed doing this in a window bomb, where gas generant tablets are ignited with a laser and combustion is monitored visually with a high-speed camera.

Example 4

A further improvement realized from the addition of S-glass fibers is the reduction in formation of undesirable gaseous combustion products. By eliminating second-rate combustion and reignition of the generant and maintaining the integrity of the combustion surface, fewer undesirable gas products are generated as shown in FIG. 4 and Table 3. More specifically, Table 3 shows numerical results for gas effluent results from inflator deployments shown in FIG. 4 compared to ⅛ USCAR limits. Comparison of gas effluent results of Comparative Example A (E-glass fibers), Comparative Example C ($SiO_2$ additive), Comparative Example E (E-glass fibers), where a conventional cool and fast burning gas generant comprising guanidine nitrate, basic copper nitrate, melamine nitrate, potassium perchlorate serves as a baseline. The results on the left for Comparative Examples A-C and Example 2 having S-type glass fibers were gathered in an inflator with Type A Filter, while the results on the right for Comparative Example E and Example 2 were obtained from inflators using an inflator with a Type B filter.

TABLE 3

| MODULE EFFLUENT | | | | | | | |
|---|---|---|---|---|---|---|---|
| | Load Weight 14.4 g Filter | | | | | | |
| | Type A Filter | | | | Type B Filter | | |
| | Formulation (Example (Ex.) or Comparative Example (CE) | | | | | | |
| | CE A | CE C | CE E | Ex. 2 | CE E | Ex. 2 | USCAR Limits |
| $NH_3$ | 9.8 | 8.4 | 3 | 7.8 | 5.9 | 6.2 | 6.3 |
| CO | 81 | 78 | 71 | 72 | 78 | 77 | 57.6 |
| NO | 13.3 | 11 | 16 | 10.6 | 6.8 | 7.7 | 9.4 |
| Airborne | 12.2 | 10.5 | 14 | 12.2 | 8.2 | 8.6 | 15.6 |

Thus, S-type glass fibers are unique in acting as a combustion stabilizer through improved slag formation and retention of the hot solid combustion products at the surface of the burning gas generant.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method for improving combustion stability in a gas generant for an inflatable restraint system, the method comprising:

introducing a plurality of S-type glass fibers into a mixture comprising at least one fuel and at least one oxidizer to form the gas generant, wherein each S-type glass fiber comprises silicon dioxide at greater than or equal to about 60% by mass, aluminum oxide at greater than or equal to about 20% by mass, and magnesium oxide at greater than or equal to about 9% by mass, and has a thermal softening point temperature ($T_d$) of greater than or equal to about 1,000° C., wherein the mixture exhibits flame extinguishment and/or reignition during combustion when the plurality of S-type glass fibers is absent, and the gas generant comprising the plurality of the S-type glass fibers is substantially free of flame extinguishment and/or reignition behavior and any associated pressure excursions during combustion.

2. The method of claim 1, wherein an amount of S-type glass fibers in the gas generant after the introducing is less than or equal to about 10% by weight of the gas generant.

3. The method of claim 1, wherein the amount of S-type glass fibers is greater than or equal to about 1% by weight to less than or equal to about 5% by weight of the gas generant.

4. The method of claim 2, wherein the thermal softening point temperature ($T_d$) of the plurality of S-type glass fibers is greater than or equal to about 1,300° C.

5. The method of claim 1, further comprising combusting the gas generant, where the combusting is substantially completed in less than or equal to about 50 milliseconds.

6. The method of claim 5, wherein the combusting of the gas generant occurs at a temperature of −40° C.

7. The method of claim 1, wherein the at least one fuel comprises a primary fuel and a secondary fuel comprising melamine nitrate at greater than or equal to about 1% by weight to less than or equal to about 20% by weight of the gas generant and the at least one oxidizer comprises a primary oxidizer and at least one secondary oxidizer comprising potassium perchlorate at greater than or equal to about 5% by weight to less than or equal to about 20% by weight of the gas generant, wherein during the combusting, the gas generant exhibits (i) a linear burn rate of greater than or equal to about 20 mm/second at 20 MPa, (ii) a burn rate slope is less than or equal to about 0.45, (iii) a maximum flame temperature at combustion ($T_c$) is less than or equal to about 2100K.

8. The method of claim 7, wherein the primary fuel comprises guanidine nitrate at greater than or equal to about 20% by weight to less than or equal to about 60% by weight of the gas generant and the primary oxidizer comprises basic copper nitrate at greater than or equal to about 20% by weight to less than or equal to about 60% by weight of the gas generant.

9. The method of claim 1, wherein the plurality of S-type glass fibers are milled and each S-type glass fiber of the plurality of S-type glass fibers has an average aspect ratio (AR) ranging from about 10:1 to about 20:1 and has a length of greater than or equal to about 60 micrometers to less than or equal to about 260 micrometers.

10. The method of claim 1, wherein each S-type glass fiber of the plurality of S-type glass fibers has silicon dioxide at greater than or equal to about 61% by mass, aluminum oxide at greater than or equal to about 23% by mass, magnesium oxide at greater than or equal to about 9% by mass, boron oxide at greater than or equal to about 4% by mass, calcium oxide at about 0.05% by mass, cumulative other oxides at about 0.06% by mass, and a balance impurities, which has a modulus of elasticity of greater than or equal to about 85 MPa, a tensile strength of greater than or equal to about 4,500 MPa, a percent elongation of greater than or equal to about 5%, and a density of greater than or equal to about 2,400 kg/m$^3$.

11. A gas generant composition comprising:

a primary fuel;

melamine nitrate at greater than or equal to about 1% by weight to less than or equal to about 20% by weight of the gas generant composition;

a primary oxidizer;

potassium perchlorate at greater than or equal to about 5% by weight to less than or equal to about 20% by weight of the gas generant composition; and a plurality of S-type glass fibers, each S-type glass fiber comprising silicon dioxide at greater than or equal to about 60% by mass, aluminum oxide at greater than or equal to about 20% by mass, and magnesium oxide at greater than or equal to about 9% by mass and having a thermal softening point temperature ($T_d$) of greater than or equal to about 1,000° C., wherein during combustion of the gas generant composition: (i) a linear burn rate is greater than or equal to about 20 mm/second at 20 MPa, (ii) a burn rate slope is less than or equal to about 0.45, and (iii) combustion is substantially free of extinguishment or reignition behavior and any associated pressure excursions.

12. The gas generant composition of claim 11, wherein the plurality of S-type glass fibers is present at greater than or equal to about 1% and less than about 10% by weight of the gas generant composition.

13. The gas generant composition of claim 11, wherein the primary fuel comprises guanidine nitrate and is present at greater than or equal to about 20 to less than or equal to about 60 weight % of the total gas generant composition, and the primary oxidizer comprises basic copper nitrate that is present at greater than or equal to about 20 to less than or equal to about 60 weight % of the total gas generant composition.

14. The gas generant composition of claim 11, wherein the amount of S-type glass fibers is greater than or equal to about 1% by weight to less than or equal to about 5% by weight of the gas generant.

15. The gas generant composition of claim 11, wherein the thermal softening point temperature ($T_d$) of the plurality of S-type glass fibers is greater than or equal to about 1,300° C.

16. The gas generant composition of claim 11, wherein (ii) the burn rate slope is less than or equal to about 0.42 and during combustion of the gas generant composition: (iv) a maximum flame temperature at combustion ($T_c$) is less than or equal to about 2100K.

17. The gas generant composition of claim 11, wherein the plurality of S-type glass fibers are milled and each S-type glass fiber of the plurality of S-type glass fibers has an average aspect ratio (AR) ranging from about 10:1 to about 20:1 and has a length of greater than or equal to about 6 micrometers to less than or equal to about 260 micrometers.

18. The gas generant composition of claim 11, wherein each S-type glass fiber of the plurality of S-type glass fibers has silicon dioxide at greater than or equal to about 61% by mass, aluminum oxide at greater than or equal to about 23% by mass, magnesium oxide at greater than or equal to about 9% by mass, boron oxide at greater than or equal to about 4% by mass, calcium oxide at about 0.05% by mass, cumulative other oxides at about 0.06% by mass, and a balance impurities, which has a modulus of elasticity of greater than or equal to about 85 MPa, a tensile strength of greater than or equal to about 4,500 MPa, a percent elongation of greater than or equal to about 5%, and a density of greater than or equal to about 2,400 kg/m$^3$.

19. The gas generant composition of claim 11, wherein the burn rate slope is less than or equal to about 0.42.

20. A gas generant composition comprising:

a primary fuel comprising guanidine nitrate at greater than or equal to about 20 to less than or equal to about 60 weight % of the total gas generant composition;

melamine nitrate at greater than or equal to about 1% by weight to less than or equal to about 20% by weight of the gas generant composition;

a primary oxidizer comprising basic copper nitrate at greater than or equal to about 20 to less than or equal to about 60 weight % of the total gas generant composition;

potassium perchlorate at greater than or equal to about 5% by weight to less than or equal to about 20% by weight of the gas generant composition; and a plurality of S-type glass fibers at greater than 0 to less than or equal to about 10 weight % of the total gas generant composition, each S-type glass fiber comprising silicon dioxide at greater than or equal to about 60% by mass, aluminum oxide at greater than or equal to about 20% by mass, and magnesium oxide at greater than or equal to about 9% by mass and having a thermal softening point temperature ($T_d$) of greater than or equal to about 1,000° C., and one or more additives cumulatively present at greater than or equal to 0% to less than or equal to about 10% by weight of the gas generant composition, wherein during combustion of the gas generant composition: (i) a linear burn rate is greater than or equal to about 20 mm/second at 20 MPa, (ii) a burn rate slope is less than or equal to about 0.45, (iii) a maximum flame temperature at combustion ($T_c$) of less than or equal to about 2100K, and (iv) combustion is substantially free of extinguishment or reignition behavior and any associated pressure excursions.

* * * * *